US005309990A

United States Patent [19]

Lance

[11] Patent Number: 5,309,990

[45] Date of Patent: May 10, 1994

[54] COILED TUBING INJECTOR

[75] Inventor: Raymond E. Lance, Fort Worth, Tex.

[73] Assignee: Hydra-Rig, Incorporated, Ft. Worth, Tex.

[21] Appl. No.: 736,698

[22] Filed: Jul. 26, 1991

[51] Int. Cl.[5] ..... E21B 19/08; E21B 19/22

[52] U.S. Cl. ..... 166/77; 166/384; 226/172; 226/173

[58] Field of Search ..... 166/77, 385, 384; 226/173, 172

[56] References Cited

U.S. PATENT DOCUMENTS

| | | | |
|---|---|---|---|
| 2,567,009 | 9/1951 | Calhoun et al. | 166/1 |
| 3,056,535 | 10/1962 | Baugh et al. | 226/172 |
| 3,182,877 | 5/1965 | Slator et al. | 226/172 |
| 3,216,639 | 11/1965 | Castela | 226/173 |
| 3,285,485 | 11/1966 | Slator | 166/77 X |
| 3,373,818 | 3/1968 | Rike et al. | 166/77 |
| 3,401,749 | 9/1968 | Daniel | 166/46 |
| 3,559,905 | 2/1971 | Palynchuk | 166/77 X |
| 3,618,840 | 11/1971 | Courret | 226/172 |
| 3,638,288 | 2/1972 | Pryor | 226/173 |
| 3,667,554 | 6/1972 | Smitherman | 175/57 |
| 3,690,136 | 9/1972 | Slator et al. | 72/160 |
| 3,724,567 | 4/1973 | Smitherman | 175/203 |
| 3,778,094 | 12/1973 | Grolet et al. | 226/172 X |
| 3,827,487 | 8/1974 | Jackson et al. | 166/77 |
| 3,866,882 | 2/1975 | Willm et al. | 254/29 R |
| 3,920,076 | 11/1975 | Laky | 166/315 |
| 4,013,205 | 3/1977 | Fabre-Curtat et al. | 226/173 |
| 4,585,061 | 4/1986 | Lyons, Jr. et al. | 166/77 |

FOREIGN PATENT DOCUMENTS 953644 8/1974 Canada .

*Primary Examiner*—Hoang C. Dang
*Attorney, Agent, or Firm*—Marc A. Hubbard

[57] ABSTRACT

There is provided an improved coiled tubing injector for injecting and withdrawing a length of flexible, cylindrical tubing into and from a well bore. The improved injector comprises first and second sets of gripper shoes, and drive mechanism for moving the sets of gripper shoes around first and second endless paths, respectively. The endless paths include parallel sections disposed on opposite sides of a length of the tubing. Within these parallel sections, the gripper shoes are pressed against the tubing with sufficient force to hold the tubing therebetween. Each gripper shoe includes a base portion connected to the drive mechanism and at least two substantially nondeformable gripper elements, each having cylindrical gripping surfaces corresponding to the outer surface of the tubing. A body of elastomeric material connects the gripper elements to the base portion and permits movement of the gripper elements between open and closed positions.

20 Claims, 6 Drawing Sheets

COILED TUBING INJECTOR

BACKGROUND OF THE INVENTION

The present invention relates to an apparatus for handling a continuous length of coiled tubing for insertion into or removal from a well bore, such apparatus is commonly referred to in the art as a coiled tubing injector.

Coiled tubing injectors of the type described in U.S. Pat. No. 4,585,061 were originally used during workover operations to inject a relatively small diameter, continuous length of coiled tubing into a well bore while the well was under pressure. In such a case, the tubing must be literally forced or "injected" into the well through a sliding seal to overcome the well pressure until the weight of the tubing exceeds the force produced by the pressure acting against the cross-sectional area of the tubing. Thereafter, the weight of the tubing has to be supported by the injector. The process is reversed as the tubing is removed from the well. In recent years, the coiled tubing has been used in combination with a mud turbine motor to drill original bores, has been used as the permanent tubing in production wells, and continues to be used in various workover and service applications. Because of the advantages of continuous coiled tubing, and the resulting new uses, the state of the art of manufacturing coiled tubing has rapidly progressed until tubing is almost three inches in diameter. These large tubings have a wall thickness and sufficient tinsel strength to support up to 20,000 feet hanging in a well bore.

The only method by which a continuous length of tubing can be either forced against pressure into the well, or supported while hanging in the well bore, while lowered or raised is by continuously gripping the tubing along its length. This is achieved by arranging continuous chain loops on opposite sides of the tubing with active reaches extending parallel to the tubing just before it enters the well bore. The continuous chains carry a series of gripper shoes which are pressed against opposite sides of the tubing and grip the tubing.

In order to handle progressively larger, longer, and heavier tubing, the gripping force must be progressively increased. This can be achieved by increasing the force pressing the gripper shoes against the tubing, by increasing the number of gripper shoes by increasing the length of the chains, by increasing the contact area of the gripper shoe, or by improving the gripping surfaces.

As the length of the chain increases, the tolerance problems to insure that all of the individual grippers are contacting the tubing with equal force presents a practical limitation, which has been reached with current designs. The application of greater force to press the grippers against the tubing, is an even more clear limitation because this will deform. Current grippers are already surfaced with carbide grit which penetrates the surface of the tubing to the point of damaging the tubing. The use of carbide surface treatment is relatively extensive and the expensive chain must be replaced frequently because when the grit wears smooth, the grippers can no longer effectively handle the tubing. The grippers can encircle only a limited percentage of the circumference of the tubing because the grippers must engage and disengage from the tubing at the beginning and end of the active reaches of the chains, and any attempts to increase the circumferential contact has resulted in unacceptable marring of the surface of the tubing to the point of causing the tubing to fail. Any increase in the force applied to the gripper results in unsatisfactory deformation of the tubing, typically causing it to become permanently egg-shaped. All of these design variables have reached the practical limits using current designs for moderately sized tubing, and the larger tubing cannot be satisfactorily handled, except in relatively shorter lengths, with even larger and longer tubing presently being demonstrated.

SUMMARY OF THE INVENTION

The present invention is concerned with an improved tubing injector which is capable of handling larger diameters and longer lengths of continuous coiled tubing without adversely affecting the tubing.

The improved injector utilizes grippers which increase the extent of circumferential contact without scuffing the tubing during engagement and disengagement, which positively maintain the tubing perfectly round regardless of the gripping force applied, thus allowing increased force to be used, which reduce the tolerance requirements of the chains, skates and grippers thus permitting longer chains and increased numbers of gripper shoes to be used, and which permits easy replacement of the gripper shoes while the unit is in operative position on the well head supporting a coiled tubing with minimum downtime, thus permitting the economical use of surface treated gripper elements which are subject to accelerated wear. This allows substantial increases in the area of contact, both circumferentially and longitudinally of the tubing and also allows substantially greater forces to be applied to force the grippers against the tubing because the tubing is contained in a uniform circle to prevent deformation. This is achieved by gripper elements which automatically close around the tubing and automatically open in such a manner as to prevent scuffing or otherwise damaging the tubing during engagement and disengagement. In accordance with another important aspect of the invention, the tolerance build-ups between metal to metal components associated with prior injectors are compensated in such a manner as to permit a substantially uniform gripping force on the tubing along the entire active reach of each of the chains, thus effectively permitting a greater number of grippers to be used with the higher forces without danger of excess peak force being concentrated on a few of the pairs of gripper shoes.

Still another aspect of the invention permits the grippers on the chains to be individually replaced without disassembling the unit, while the unit is in place on the well head and is supporting a coiled tubing in the well bore, thus permitting economical replacement of worn or damaged grippers.

These and other advantages are achieved in accordance with the present invention by utilizing a plurality of sets of opposed gripper shoes, each set mounted on an endless loop of chain. The endless chains are disposed with parallel, active reaches on opposite sides of the tubing so that the gripper shoes can be forced against the tubing from opposite directions by forcing one or more skates against rollers carried by the respective chains. Each of the gripper shoes has a plurality of gripper elements, preferably two, which collectively engage the tubing over essentially a full 180° to provide maximum surface contact. The force on each element is applied essentially radially, through the center of the element, and the elements are arranged so that each force is directly opposed by the force from an element on the mating gripper shoe carried by the other endless chain, and the sets of forces are directed against the tubing at equally spaced angles around the circumference of the tubing. For example, if each gripper shoe carries two gripper elements, the forces are applied at 90° intervals around the circumference of the tubing.

In accordance with an important aspect of the invention, the individual gripper elements are floatingly or pivotally mounted in a normally open position when not forced against the tubing so that the outer edges of the elements are spread wider than the diameter of the tubing. The elements are automatically closed after the element first engages the tubing by the force of moving the gripper shoes toward the tubing, thus permitting the gripper to be engaged around substantially the entire circumference of the tubing without scuffing the tubing.

The multiple elements in each of the gripper shoes are preferably "floated" in an elastomeric material in such a manner that the elements are in a slightly open position when not engaging the tubing, and when pressed into engagement with the tubing, automatically pivot in such a manner as to close without scuffing the tubing. The pivotal movement of the elements results in the force being applied substantially uniformly toward the center of the tubing, thus confining the tubing in substantially a perfect circle to eliminate deformation of the tubing within the magnitude of the forces necessary to cover the grit to fully penetrate and engage the surface of the tubing.

In accordance with another aspect of the invention, the elastomeric material in which the elements float also transfers the force to the gripper element, also providing a means for counteracting the tolerance build-up in conventional injector systems employing only metal to metal contacts between moving components. Thus the tolerances in the mechanism including the surface of the skates used to engage the chain rollers, the bearings of the rollers, the surfaces of the roller and the dimensional manufacturing tolerances of the body parts are largely compensated. Since the force applied to each gripper shoe is more uniform, the total force applied to all of the gripper shoes can be increased with less danger that the force will be concentrated in an out-of tolerance gripper shoe which would result in an unacceptably high force concentration on the tubing.

In accordance with another important aspect of the invention, the individual gripper shoes are connected to the chain by threaded fasteners which are easily accessible, without demounting the chain, to permit worn or damaged gripper shoes to be economically replaced while the injector unit is in place on the work site holding the tubing suspended in the well bore with no significant interruption in the use of the injector unit.

Those skilled in the art will recognize and appreciate other features and advantages of the present invention from the following detailed description of the preferred embodiment when read in conjunction with the accompanying drawings.

DESCRIPTION OF THE PREFERRED EMBODIMENTS

Figure 1:
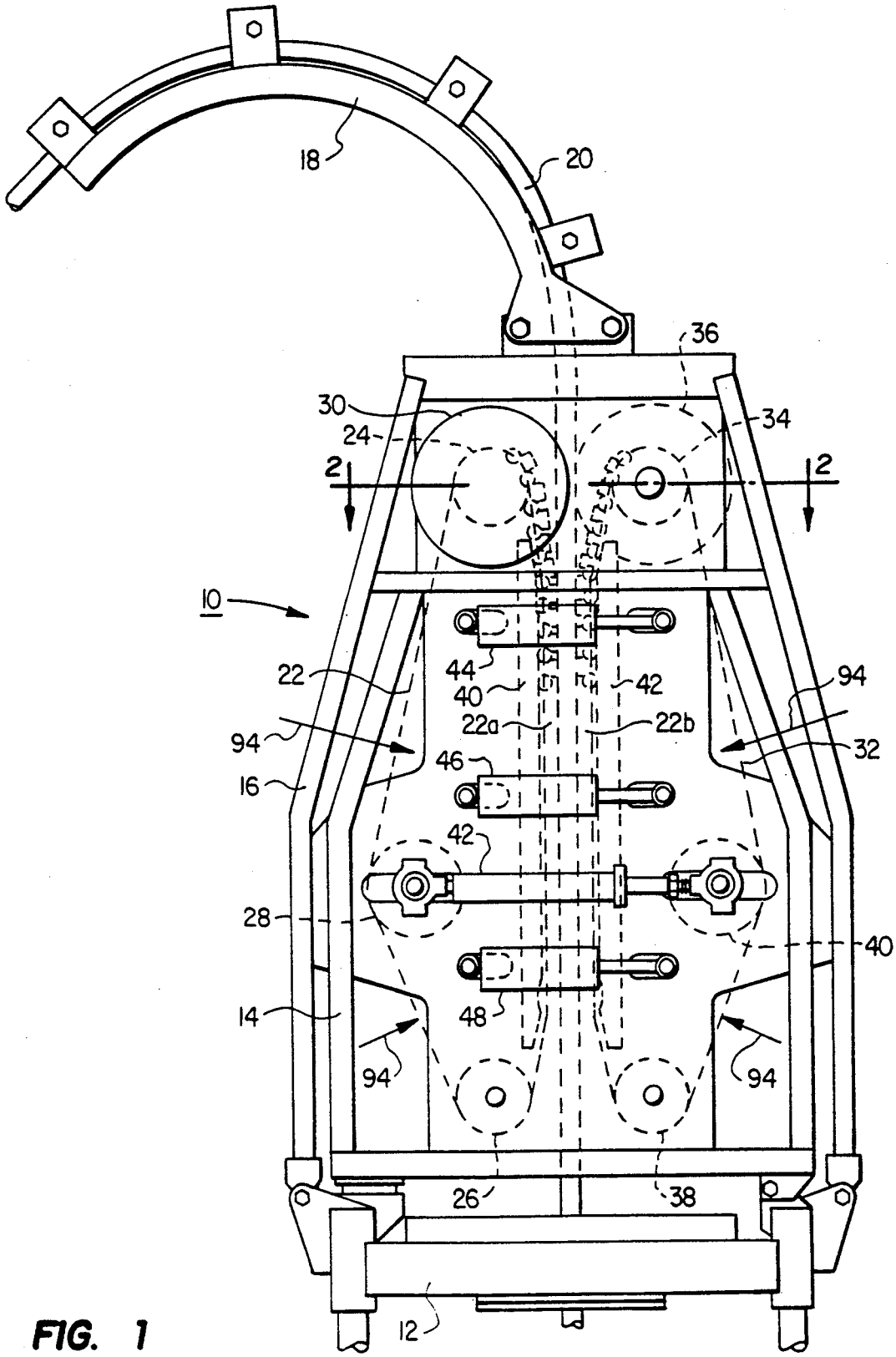
FIG. 1 is a simplified side elevational view of a coiled tubing injecting apparatus in accordance with the present invention.
Figure 2:
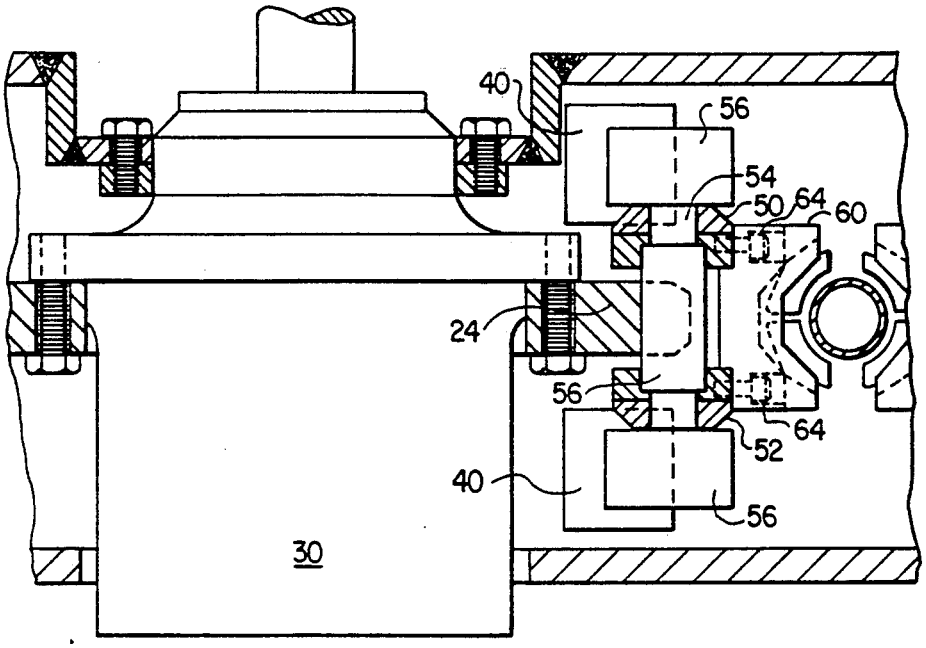
FIG. 2 is a partial sectional view taken substantially on lines 2—2 of FIG. 1.
Figure 4:
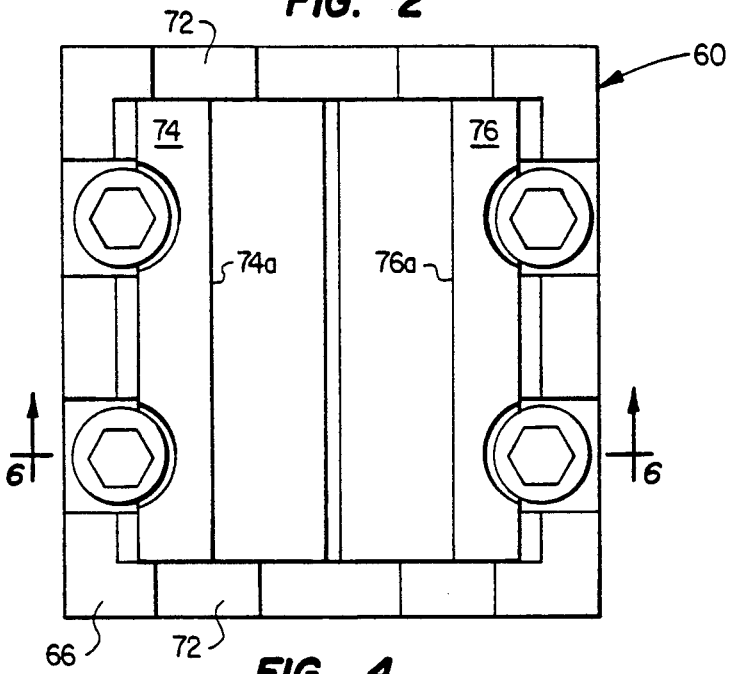
FIG. 4 is a view of the face of a gripper shoe which engages the tubing constructed in accordance with the present invention.
Figure 5:
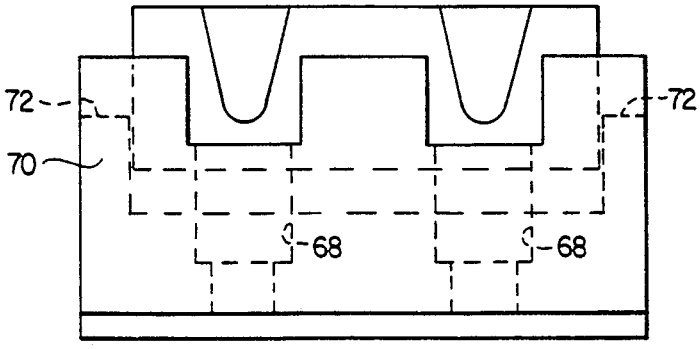
FIG. 5 is a side view of the gripper shoe of FIG. 4.

In the description which follows, like parts are designated throughout the specification and drawings with the same reference characters. The drawings are not necessarily to scale, and certain features and certain views of the drawings may be shown exaggerated in scale or in schematic form in the interest of clarity and conciseness.

Referring now to FIG. 1, an injector system in accordance with the present invention is indicated generally by the reference numeral 10. The injector system 10 includes a base 12 which is typically connected to and supported by the well head, a load frame 14 which is mounted on the base 12, and a carrying frame 16 which is also connected to the base 12 and used to lift the injector during installation on the well head. A suitable guide mechanism 18 is mounted on the frame 16 to feed a continuous length of coiled tubing 20 into the injector 10. The apparatus thus described is substantially the same as that described in the above referenced U.S. Pat. No. 4,585,061.

A first endless chain in accordance with the present invention is indicated generally by the reference numeral 22 and is mounted on a drive sprocket 24 and idler sprocket 26 and is tensioned by a tensioning sprocket 28. The drive sprocket 24 is driven by a hydraulic motor 30. A second, substantially identical endless chain 32 is mounted on idler sprocket 38 and drive sprocket 34 which is driven by a hydraulic motor 36. The chain 32 is tensioned by sprocket 40. Equal tension is maintained on the two chains by a hydraulic cylinder 42 which spreads the tension sprockets 28 and 40. Each of the endless chains 22 and 32 extend downwardly along substantially parallel active reaches **22*a* and 22*b* and are urged against the tubing 20 by rigid skates 40 and 42, respectively, which have a unique surface contour which will be hereafter described. The skates 40 and 42 are pulled together by hydraulic cylinders 44, 46 and 48**, which are connected to a common hydraulic pressure source to maintain uniform pressure along the lengths of the two skates.

Figures 3, 10:
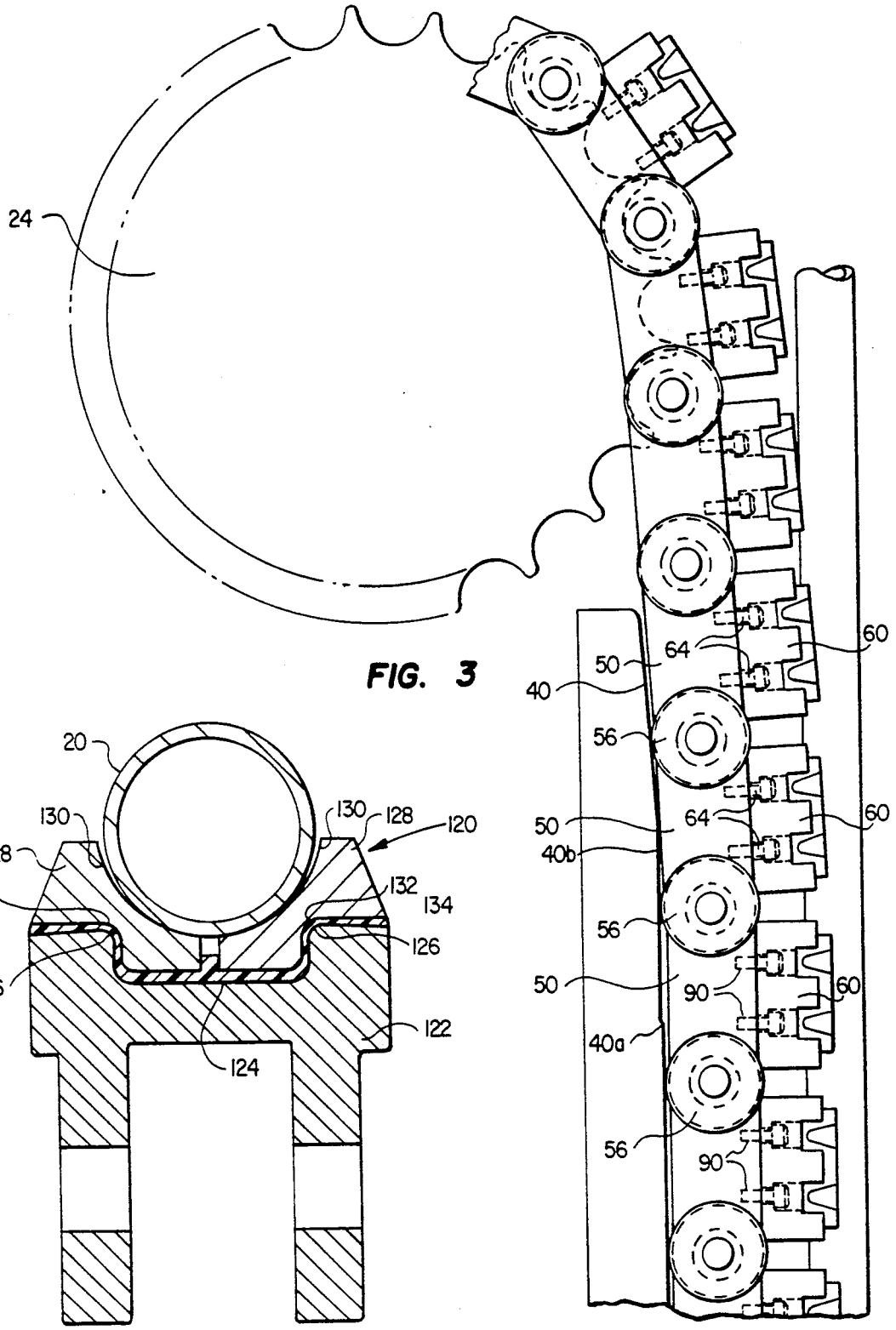
FIG. 3 is a partial enlarged side elevational view of the apparatus of FIG. 1.
FIG. 10 is a sectional view similar to FIG. 6 showing still another embodiment of a gripper shoe of the present invention.

Each of the chains, 22 and 32 are preferably of the type conventionally employed on tracked vehicles. Each link includes a pair of parallel members 50 and 52 which extend between successive connecting pins 54. Rollers 56 are mounted on the pins 54 between the link members 50 and 52 and are carried on the teeth of the sprocket 24. The rollers 56 are positioned to be engaged by the respective skates 40 or 42. Each end of each of the skates 40 and 42 are preferably configured as best illustrated in FIG. 3 and includes a tapered section 40*a* which progressively moves the gripper shoe toward engagement with the tubing, and a straight section 40*b* which extends parallel to the center of the tubing and are adjacent to, but not gripping the tubing, and a straight section beginning at step 40*c* which forces the gripper shoes against the tubing with the desired force. The skates 40 and 42 have the same sections 40*a* and 40*b* at the lower ends, although only the upper end of skate 40 is illustrated for simplicity.

Figure 6:
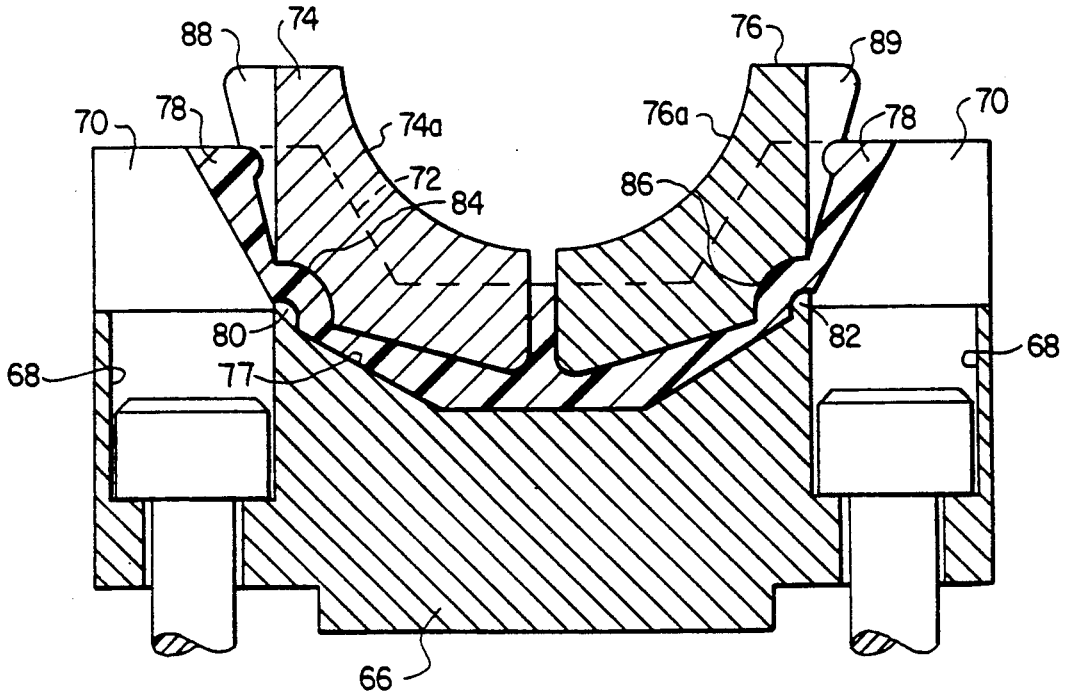
FIG. 6 is a sectional view taken substantially on lines 6—6 of FIG. 4.

A series of gripper shoes 60 extends substantially the length of each pair of members 50 and 52 and are bolted to each member by a pair of Allen head bolts 64. Each of the gripper shoes 60 includes a generally rectangular body 66 having four corresponding countersunk bolt holes 68, as best illustrated in FIG. 6. Each body 66 has a recess or cavity 77 formed by sidewalls 70 and end walls 72, the configuration of which is shown in dotted outline in FIG. 6. A pair of gripper elements 74 and 76 are mounted in the recess 77 by a body of elastomeric material 78 which has been molded in place so as to be bonded to both the body 66 and to the respective elements 74 and 76. The gripper elements 74 and 76 have cylindrically concave surfaces 74*a* and 76*a*, respectively, which have the exact radius of curvature as the external diameter of the coiled tubing which is being handled. The concave surface is preferably coated with a tungsten carbide or other suitable grit (not illustrated) in the conventional manner. Each of the elements 74 and 76 extends between the two end walls 72 of the shoe body 66 so that longitudinal thrust loads resulting from the tubing 20 are transmitted by metal to metal contact to surface 73 and therefore back to the chain, rather than through the body of elastomeric material 78, which is used only to transmit forces transverse to the longitudinal axis of the tubing.

The cavity 77 in the body 66 is configured such that an appropriate amount of elastomeric material 78 is positioned between the body 66 and the respective element 74 and 76 to provide the desired resilient deformation. The elastomeric material is essentially incompressible and sufficient resistance to deformation so as to provide the desired force transmission from the body 66 to the respective gripper elements 74 and 76. Accordingly, the stiffness or durometer of the elastomeric material 78 is selected to provide the force required without excessive deformation. A pair of semi-circular fulcrum points 80 and 82 extend the length of the cavity 77 in the body 66 and project into larger radius fulcrum cavities 84 and 86 formed in the elements 74 and 76, respectively, for purposes which will presently be described. Recesses 88 and 89 are provided in the elements 74 and 76 to permit access to the bolts in the bolt holes 68 used to removably secure the gripper shoes to the chain.

Figure 7:
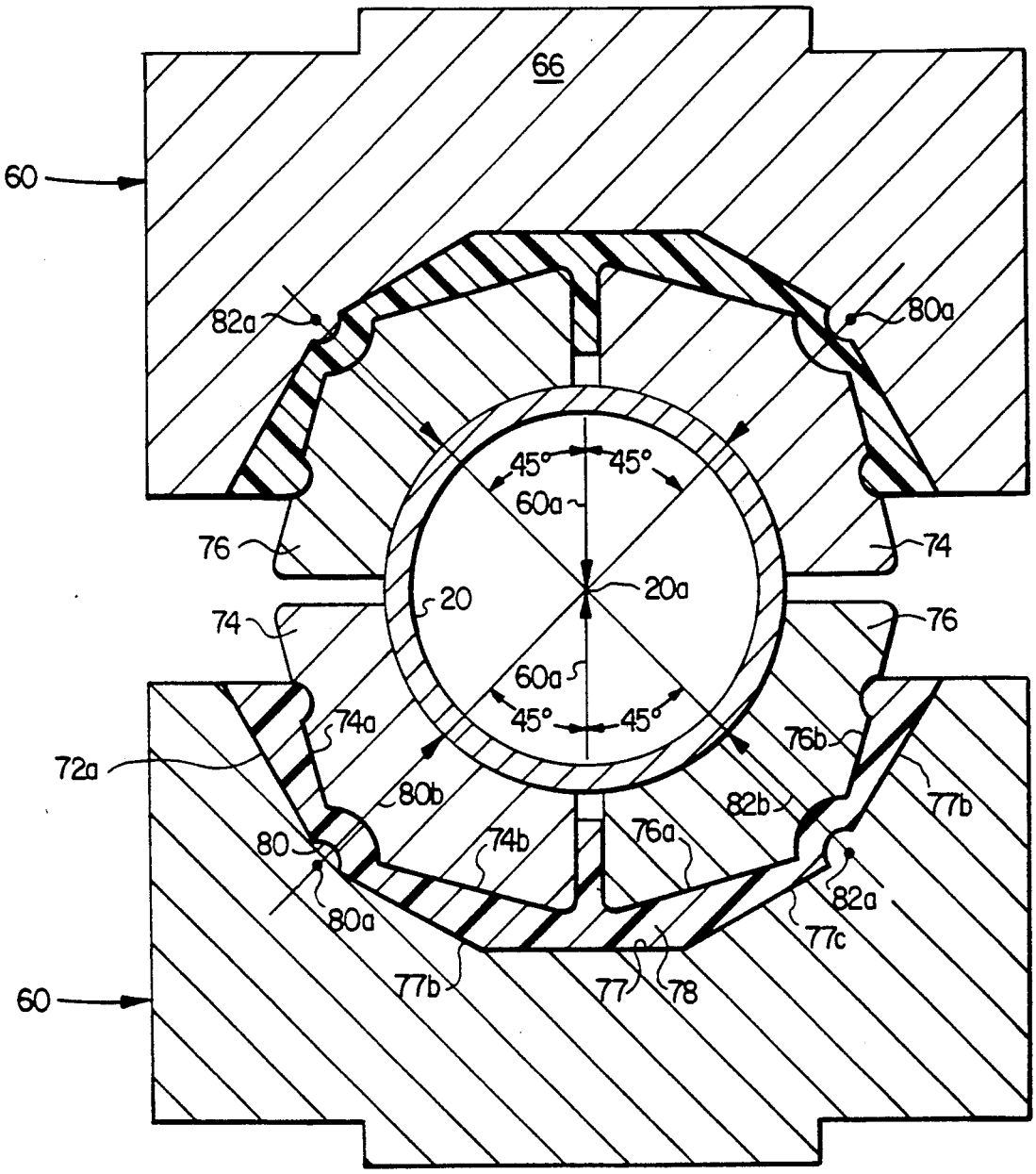
FIG. 7 is a sectional view of the two gripper shoes of FIG. 6 closed on and gripping coiled tubing.

FIG. 7 is a cross-sectional schematic view taken through the center of a pair of gripper shoes which are pressed against the tubing 20 in operating position. The center of the tubing 20 is represented at point 20*a*. It will be noted that fulcrums 80 and 82 of the lower illustrated gripping shoe 60 are disposed at 45° angles from the center of the tubing 20 as compared to the direction of force applied to the gripper shoe, which is represented by arrows 60*a*. The fulcrum grooves 84 and 86 are similarly centered about the center of fulcrum surfaces 80 and 82. The surfaces 77*a* and 77*b* of the recess 77 which are adjacent the fulcrums 80 are symmetrical about the force line 80*b* and 82*b*, as are the adjacent surfaces 74*a* and 74*b* and 76*a* and 76*b* of the gripper elements. This results in the body of elastomeric 78 also being symmetrical.

Each of the gripper elements 74 and 76 of the opposite (upper in the drawings) gripper shoe are therefore directly opposed to those on the lower gripper shoe. As a result, the force applied by the respective gripper elements 74 and 76 of the upper and lower gripper shoes are symmetrically disposed at 90° intervals around the entire circumference of the tube, and the radius of curvature of the gripper elements precisely matches that of the tubing exterior surface when the surface grit is appropriately penetrating the surface of the tubing. The elastomeric material 78 ensures that the opposing forces along lines 80*b* an 82*b* are applied uniformly to the tubing since the elastomeric material 78 flows both longitudinally and circumferentially about the elements as required to maintain the desired force. The spacing between adjacent edges of the gripper elements can be made very small, typically less than the wall thickness of the tubing, so that the tubing cannot be deformed to a shape other than round within the range of useful forces applied along force line 60*a*.

Figure 8:
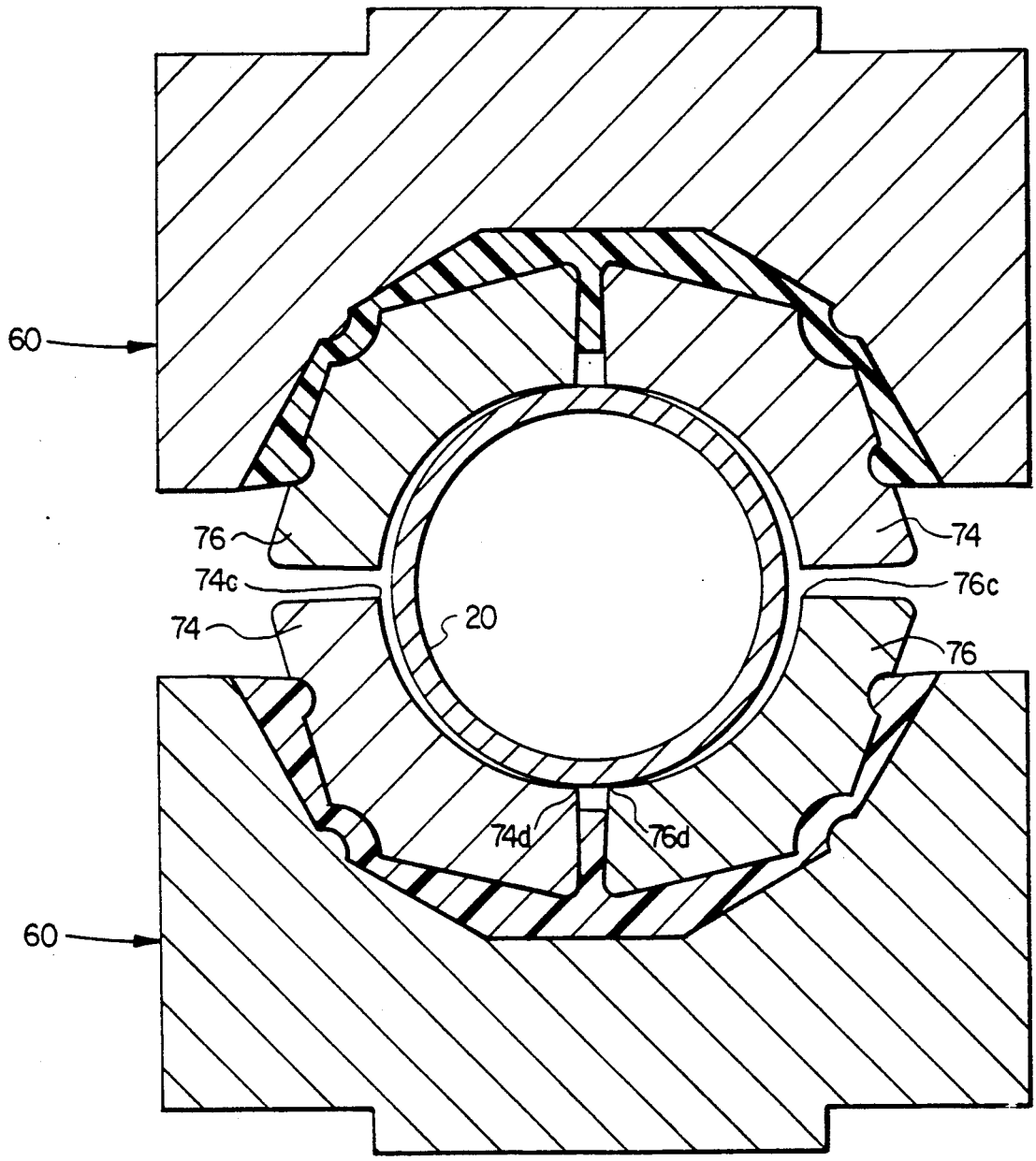
FIG. 8 is a schematic illustration similar to FIG. 7, showing the gripper element in the open position, with the degree of opening substantially exaggerated for purposes of illustration.

The uniform force loading on or about the circumference of the tubing so depicted in FIG. 7 can be achieved without scuffing the tubing as the gripping elements engage and disengage the tubing at the beginning and end of the active reaches of the chains because the gripper elements 74 and 76 are oriented in the open positions illustrated in FIG. 8 when not forced against the tubing by the skate 40 and 42 engaging the rollers 56 of the respective chains. This open position is achieved by locating the gripping elements 74 and 76 in the positions illustrated in FIG. 8 relative to the body 66 at the time the elastomeric material is poured and cured so that the unstressed shape of the elastomeric material is as illustrated. It will be noted that the elements 74 and 76 are rotated slightly around the pivot points 80*a* and 82*a* so that outer corners 74*c* and 76*c* are spaced apart a distance slightly greater than the distance between the two corners when engaging the tubing as illustrated in FIG. 7. For instance, each corner need only be located outwardly about 0.015 inches to provide adequate clearance for the elements 74 and 76 to first engage the tubing at the inner corners 74*d* and 76*d*. Then as the gripper shoes 60 are moved together along force lines 60*a*, the gripper elements will be pivoted generally about pivot points 80*a* and 82*a* until the cylindrical faces of the elements mate precisely with the exterior surface of the tubing at which time further movement of the gripper shoes toward the tubing results in forces being transmitted to the tubing substantially along force lines 80*b* and 82*b*.

The shape of each end of each of the skates 40 and 42 are preferable as illustrated in FIG. 3 to assist in closing the gripper elements on the tubing without scuffing, denting or otherwise adversely affecting the tubing. The surfaces of the skates which engage the rollers 56 is straight for the lengths of the active reach as of the chains beginning at step 40*c* and is spaced from the center line of the tubing by a distance corresponding to the fully loaded position illustrated generally in FIG. 7. The skates have a tapered section or inclined ramp 40*a* from the end of the skate to point 40*b*, and a staging section from point 40b to point 40a which is parallel to the center line of the tubing, but spaced from the center line by distance such as to position the gripper element in the open position illustrated in FIG. 8. The staging section is preferably the length of distance between two rollers 56 so that the corners 74c and 76c of the gripper elements will engage the tubing along the entire length of the gripper elements. When the rollers reach step 40a, the gripper shoes are moved toward the tubing until the gripper elements are pivoted into the closed position and fully engage the tubing as illustrated in FIG. 7.

In accordance with another important aspect of the invention, the gripper elements are "floated" in the elastomeric material 78 without metal to metal contact so that the collective tolerance requirements of the surface of the skates, the radius of the rollers, the bearings of the rollers, the dimensions of the chain links, and the thickness of the gripper shoes is significantly reduced. The resilient effect of the elastomeric material allows the force exerted by the hydraulic cylinders 44, 46, and 48 on the skates to be significantly increased without danger that the force will be concentrated on one pair of gripper shoes and thus damage the tubing.

In accordance with another important aspect of the present invention, the gripper shoes are connected to the chain links by bolts passed through the shoes from the face which engages the tubing and are threaded into taped bores 90 in the chain links as best illustrated in FIG. 3. As a result, the gripper shoes can be quickly replaced even while the unit is in position on the well bore and supporting a length of coiled tubing by accessing the shoes on the outside return reach of the chain, such as at the points represented by arrows 94 in FIG. 1. Of course an appropriate power tool for engaging and rotating the Allen head bolts can expedite the task.

Figure 9:
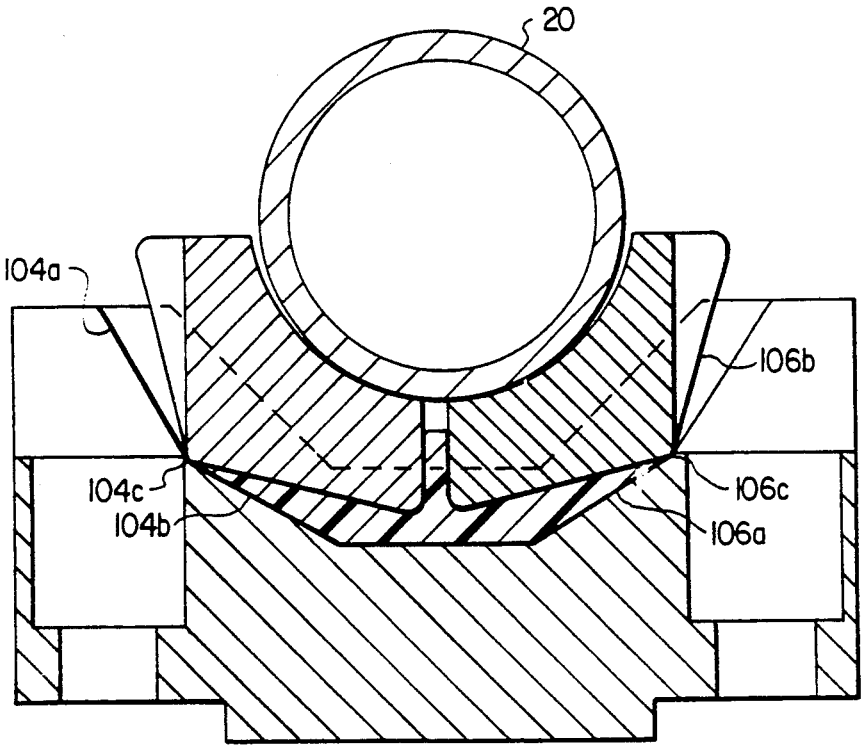
FIG. 9 is a sectional view similar to FIG. 6 illustrating an alternative embodiment of a gripper shoe in accordance with the present invention.

Another embodiment of the gripper shoe of the present invention is indicated generally by the reference numeral 100 in FIG. 9. The gripper shoe 100 includes a body 102 which is identical to the body 66 of the shoe 60, except that the fulcrum ribs 80 and 82 have been eliminated. The gripper elements 104 and 106 are also identical to the elements 74 and 76 except that the fulcrum grooves 84 and 86 have been eliminated so that a continuation of the surfaces 104a and 104b and 106a and 106b form metal fulcrum ridges 104c and 106c, respectively, which engage the metal of the body at the groove forming the apexes of the surfaces 102a and 102b of the body 102. The gripper shoe 100 is illustrated in the unloaded or "open" condition and function when loaded to close about the tubing in the same manner as previously described, in connection with gripper shoes 60, but pivoting about the "hard" metal to metal contact point, rather than the soft or "floating" pivots of the gripper shoes 60.

Still another embodiment of the present invention is illustrated in FIG. 10 and indicated generally by the reference numeral 120. The device 120 is applied to a chain of the type illustrated in the above-referenced U.S. Pat. No. 4,585,061 and includes a link of the chain 122 which has been modified to provide an upper surface 124 to form a cavity having projecting fulcrum ridges 126. A pair of gripper elements 128 have concave cylindrical surfaces 130 which are configured to precisely match the exterior radius of the tubing 20. The surfaces of the gripper elements 128 remote from the tubing form fulcrum grooves 132. A body of elastomeric material 134 is molded between the chain link 122 and the gripper elements 128. The gripper elements 128 are positioned in the slightly open position indicated, and as previously described in connection with the other embodiments of the invention, so that the tubing 20 can enter between the outer tips of the elements without scuffing. When the gripper elements are forced against the opposite sides of the tubing, the gripper elements pivot generally about the fulcrums 126–132 to close on the tubing 20 and exert forces disposed generally at 45° to the angle of force exerted by the chains, as described in connection with the gripper elements of FIG. 7. The gripper shoe 120 thus functions in substantially the same manner as the gripper shoes 60 previously described and provide substantially all of the same advantages.

From the above detailed description of preferred embodiments of the invention, it will be apparent that a significantly improved injector system has been described. The injector system utilizes an improved chain mechanism capable of exerting very large forces normal to the tubing to press the grippers against the tubing by reason of the large rollers disposed outward of the pins and the solid skates or tracks used to engage the rollers and press them against the tubing. The enlarged chain also is capable of carrying very large loads extending axially of the tubing due to the weight of the large lengths, for example 20,000 feet of larger diameter tubing, such as 3 inches, and has apparent unlimited capability for further enlargement to support tubing of both larger diameter and longer lengths. The floating gripper elements reduce the tolerance build-up limitations of prior systems, and thus permit a greater number of gripper elements to be used with a greater force applied without danger of excessive force being concentrated on a few gripper elements as the result of poor manufacturing or lost tolerances due to wear. This provides a longer life for the chain before it must be replaced due to wear. As a result, the life expectancy of the chain is expected to significantly exceed the life expectancy of surfaces of the gripper elements, which are customarily coated with a tungsten carbide grit. The minute grit must actually penetrate the surface of the tubing to provide a mechanical interlock to transfer the longitudinal force to the tubing. Thus, wearing of this tungsten carbide grit rapidly decreases in the lifting power of the unit long before the improved chain might otherwise need replacing.

The present invention thus provides gripper elements which are mounted on the chain in such a manner as to permit easy change-out of one or all of the gripper elements while the injector device is installed on a well head and is supporting tubing hanging in the well bore. This not only allows practical replacement of worn gripper shoes at more frequent intervals, but significantly reduces down time of the unit.

The multiple gripper elements provide a means for extending the active gripping surface around substantially the entire circumference of the tubing while permitting the elements to engage and disengage the tubing without scuffing or grooving the surface of the tubing causing a weakened condition. More importantly, the gripping of the tubing around its entire circumference assures that the tubing will not be deformed by any practiced forces, thus eliminating egging of the unit which has previously occurred, and preventing internal pressures within the tubing from ballooning the tubing as a result of the loss of circularity at the edges of the prior gripper shoes.

Although preferred embodiments of the invention have been described in detail, it will be obvious to those skilled in the art that various modifications, alterations, substitutions and components can be made therein without departing from the spirit and scope of the invention as defined by the appended claims.

What is claimed is:

1. Apparatus for injecting and withdrawing a length of flexible cylindrical tubing into and from a well bore, comprising:

first and second sets of gripper shoes, drive means for moving the first and second sets of gripper shoes around first and second endless paths, respectively, the paths including first and second parallel sections disposed on opposite sides of a length of the tubing during which the gripper shoes are pressed against the tubing with sufficient force to hold the tubing therebetween, each gripper shoe including:

a base portion connected to the drive means, at least two substantially non-deformable gripper elements each having a cylindrical gripping surface, each cylindrical surface having a radius of curvature corresponding to the outer surface of the tubing, at least one of the gripper elements being connected to the base portion by connection means permitting movement of the element relative to the base portion between a closed position where the cylindrical gripping surface engages the tubing and an open position which facilitates engagement and disengagement of the gripping shoe elements with the tubing so as not to scuff the tubing during engagement;

wherein the connection means comprises resilient means biasing the gripper element into the open position and wherein the movable gripper elements are normally disposed in an open position with outer corners of the elements spaced apart a distance greater than the distance between the corner of the elements when gripping the tubing and are moved into closed position against the tubing in response to the gripper elements being pressed against the tubing as the gripper shoes enter the parallel sections of the endless paths and move back to the open position as the gripper elements move away from the tubing as the gripper shoes leave the parallel sections of the endless paths; and wherein the gripping elements, when in the closed position, apply substantially even pressure to the surface of the tubing over substantially the entire length of the gripping element so as not to substantially deform the tubing.

2. The apparatus of claim 1 wherein the connection means is a body of elastomeric material surface bonded to the gripper element and to the base portion.

3. The apparatus of claim 1 wherein the connection means is arranged to transfer forces normal to the axis of the tubing through the resilient biasing means between the base portion and the gripper elements to reduce tolerance requirements in the apparatus during manufacture or wear.

4. The apparatus of claim 1 further comprising coupling means disposed at the periphery of the gripper elements for connecting each base portion to the respective drive means and operable from the face side of the gripper shoes which engages the tubing to remove and replace the respective base portion and associated gripper elements from the respective drive means while the apparatus is in operative position on a well bore, wherein the coupling means comprises threaded holes in the drive means and threaded bolts extending through the base portion into the threaded bore holes, the threaded bolts including head means accessible and operable from the face side of the gripper shoes which engages the tubing.

5. The apparatus of claim 1, further including first and second elongated skates disposed along the parallel sections of the first and second endless paths, respectively, the skates having gripping sections thereon for pressing the gripper elements of the gripper shoes into engagement with the tubing.

6. The apparatus of claim 5, wherein at least one of the skates has a tapered end section adjacent the gripping section for progressively moving the gripper shoes into alignment with the tubing without causing damage to the tubing.

7. The apparatus of claim 6, further including a staging section disposed between the tapered end section and the gripping section, the staging section being parallel to the gripping section but spaced therefrom a distance such as to position the gripper elements into engagement with the tubing in their open position.

8. A gripper shoe for apparatus for injecting and withdrawing a length of flexible cylindrical tubing into and from a well bore, including drive means for moving first and second sets of gripper shoes around first and second endless paths, respectively, the paths including first and second parallel sections disposed on opposite sides of a length of the tubing during which the gripper shoes are pressed against the tubing with sufficient force to hold the tubing therebetween, each gripper shoe comprising:

a base portion connected to the drive means, at least two gripper elements each having a cylindrical gripping surface, each cylindrical surface having a radius of curvature corresponding to the outer surface of the tubing, at least one of the gripper elements being connected to the base member by connection means permitting movement of the element relative to the base portion between a closed position where the cylindrical gripping surface engages the tubing and an open position which facilitates engagement and disengagement of the gripping shoe elements with the tubing, wherein the connection means comprises resilient means biasing the gripper element into the open position, and wherein the gripping elements, when in the closed position, apply substantially even pressure to the surface of the tubing over substantially the entire length of the gripping element so as not to substantially deform the tubing.

9. The gripper shoe of claim 8 wherein the connection means is a body of elastomeric material surface bonded to the gripper element and to the base member.

10. The gripper shoe of claim 8 wherein the connection means is arranged to transfer forces normal to the axis of the tubing through a resilient linkage between the base member and the gripper elements to reduce tolerance requirements in the apparatus during manufacture or wear.

11. The gripper shoe of claim 10 wherein the movable gripper elements are normally disposed in an open position with the outer corners of the elements spaced apart a distance greater than the distance between the corners of the elements when gripping the tubing and are moved into closed position against the tubing in response to the gripper elements being pressed against the tubing as the gripper shoes enter the parallel sections of the endless paths and move back to the open position as the gripper elements move away from the tubing as the gripper shoes leave the parallel sections of the endless paths.

12. The gripper of claim 11 wherein there are two gripper elements, each having a gripping surface for engaging substantially one fourth of the circumference of the tubing, each gripping element being mounted on the respective base member for generally pivoted movement between a closed position engaging the tubing and an open position wherein the outer edges of the elements are spread apart relative to the closed position, whereby as the gripping elements are forced against the tubing, the elements will pivot from the open position to the closed position.

13. A gripper shoe for apparatus for injecting and withdrawing a length of flexible cylindrical tubing into and from a well bore, including drive means for moving first and second sets of gripper shoes around first and second endless paths, respectively, the paths including first and second parallel sections, respectively, disposed on opposite sides of a length of the tubing during which the gripper shoes are pressed against the tubing with sufficient force to hole the tubing therebetween, each gripper shoe comprising:

a base portion for connection to the drive means, two gripper elements, each having a cylindrical gripping surface having a radius of curvature corresponding to the outer surface of the tubing, all of said gripper elements being connected to the base member by connection means permitting resilient movement of the elements relative to the base portion in the direction of movement of the gripper shoes toward the tubing as the gripper shoes enter the respective parallel paths to engage the tubing to compensate for out-of-tolerance build-up due to manufacturing and/or wear, wherein the gripping elements, when in the closed position, apply substantially even pressure to the surface of the tubing over substantially the entire gripping surface of the gripping element so as not to substantially deform the tubing.

14. The gripper shoe of claim 13 wherein the connection means is a body of elastomeric material bonding the respective gripper element to the respective base portion.

15. The gripper shoe of claim 13 further comprising apertures disposed at the periphery of the gripper elements for receiving coupling means for the respective drive means which is operable from the face side of the gripper shoes which engages the tubing to remove and replace the respective base portion and associated gripper elements from the respective drive means while the apparatus is in operative position on a well bore.

16. Apparatus for injecting and withdrawing a length of flexible cylindrical tubing into and from a well bore, comprising:

first and second sets of gripper shoes, drive means for moving the first and second sets of gripper shoes around first and second endless paths, respectively, the paths including first and second parallel sections disposed on opposite sides of a length of the tubing during which the gripper shoes are pressed against the tubing with sufficient force to hold the tubing therebetween, each gripper shoe including:

a base portion connected to the drive means, two substantially non-deformable gripper elements each having a cylindrical gripping surface, each cylindrical surface having a radius of curvature corresponding to the outer surface of the tubing, each of the two gripper elements being coupled to the base portion by a resilient elastomeric means for permitting resilient movement of the gripping elements relative to the base portion in the direction of movement of the gripper shoes toward the tubing as the gripper shoes enter the respective parallel paths to engage the tubing to compensate for out-of-tolerance build-up due to manufacturing and/or wear, each gripper element applying a force to the tubing substantially along radii of the tubing so as not to deform substantially the tube.

17. The apparatus of claim 16 wherein the cylindrical gripping surface of each gripping element extends substantially one-quarter of the circumference of the tubing.

18. The apparatus of claim 16 wherein the resilient elastomeric means permits pivoting of the gripper element relative to the base portion between an open position in which the gripper shoes engage and disengage the tubing without scuffing the tubing and a closed position in which substantially the entire cylindrical gripping surface engages the tubing.

19. The apparatus of claim 18 wherein the movable gripper elements are normally disposed in an open position with the outer corners of the elements spaced apart a distance greater than the distance between the corner of the elements when gripping the tubing and are moved into closed position against the tubing in response to the gripper elements being pressed against the tubing as the gripper shoes enter the parallel sections of the endless paths and move back to the open position as the gripper elements move away from the tubing as the gripper shoes leave the parallel sections of the endless paths.

20. The apparatus of claim 16 wherein each of the gripper elements has a gripping surface for engaging substantially one fourth of the circumference of the tubing, each gripping element being mounted on the respective base member for generally pivoted movement between a closed position engaging the tubing and an open position wherein the outer edges of the elements are spread apart relative to the closed position, and said resilient elastomeric means normally biasing the gripping elements to the open position whereby as the gripping elements are forced against the tubing, the elements will pivot from the open position to the closed position against the bias.

* * * * *